US005211500A

United States Patent [19]

Takaki et al.

[11] Patent Number: 5,211,500

[45] Date of Patent: May 18, 1993

[54] COMPOSITE ROPE HAVING MOLDED-ON FIXING MEMBER AT END PORTION THEREOF

[75] Inventors: Hiroshi Takaki; Hiroshi Kimura; Ryuichi Endo, all of Dejima, Japan

[73] Assignee: Tokyo Rope Mfg. Co., Ltd., Tokyo, Japan

[21] Appl. No.: 692,296

[22] Filed: Apr. 26, 1991

Related U.S. Application Data

[62] Division of Ser. No. 502,457, Mar. 30, 1990, Pat. No. 5,027,497.

[30] Foreign Application Priority Data

Apr. 6, 1989 [JP] Japan ..... 1-87341
Sep. 25, 1989 [JP] Japan ..... 1-248567

[51] Int. Cl.[5] ..... B25G 3/34

[52] U.S. Cl. ..... 403/269; 403/278; 403/284

[58] Field of Search ..... 403/269, 278, 284

[56] References Cited

U.S. PATENT DOCUMENTS

| | | | |
|---|---|---|---|
| 663,469 | 12/1900 | Reynolds . | |
| 663,490 | 12/1900 | Cleveland . | |
| 728,689 | 5/1903 | Ende . | |
| 1,059,124 | 4/1913 | Doxford . | |
| 1,227,726 | 5/1917 | Woodhead . | |
| 1,908,600 | 5/1933 | Green et al. | 403/278 X |
| 1,953,891 | 4/1934 | Andrew . | |
| 2,272,244 | 2/1942 | Klein . | |
| 2,389,951 | 11/1945 | Brickman . | |
| 2,446,542 | 8/1948 | Mac Innes . | |
| 2,484,485 | 10/1949 | Brickman . | |
| 2,803,486 | 8/1957 | Larson et al. . | |
| 2,955,338 | 10/1960 | Gough . | |
| 3,091,030 | 5/1963 | Zumbrunnen | 403/269 X |
| 3,405,516 | 10/1968 | Laureti . | |
| 3,461,539 | 8/1969 | Napple . | |
| 3,507,949 | 4/1970 | Campbell . | |
| 3,583,060 | 6/1971 | Sigmans | 403/284 X |
| 3,698,749 | 10/1972 | Yonkers . | |
| 3,857,229 | 12/1974 | Marzocchi . | |
| 4,043,690 | 8/1977 | Browne . | |
| 4,050,230 | 9/1977 | Senoo . | |
| 4,090,767 | 5/1978 | Tregoning . | |
| 4,130,926 | 12/1978 | Willem . | |
| 4,228,641 | 10/1980 | O'Neil . | |
| 4,242,787 | 1/1981 | De Ribas et al. . | |
| 4,250,702 | 2/1981 | Gundlach . | |
| 4,299,884 | 11/1981 | Payen . | |
| 4,303,799 | 12/1981 | Ishihara . | |
| 4,317,640 | 3/1982 | Peeling . | |
| 4,430,851 | 2/1984 | Sundet . | |
| 4,509,233 | 4/1985 | Shaw | 24/115 M X |
| 4,677,818 | 7/1987 | Honda . | |
| 4,740,101 | 4/1988 | Allen | 403/334 X |
| 4,908,943 | 3/1990 | Harel . | |

FOREIGN PATENT DOCUMENTS

| | | |
|---|---|---|
| 0082067 | 6/1983 | European Pat. Off. . |
| 2828375 | 12/1979 | Fed. Rep. of Germany . |
| 59178 | 5/1954 | France . |
| 57-25679 | 5/1982 | Japan . |
| 59-71492 | 9/1984 | Japan . |
| 61-28092 | 2/1986 | Japan . |
| 62-18679 | 4/1987 | Japan . |
| 42209 | 12/1937 | Netherlands . |
| 3627 | 6/1981 | Switzerland . |

OTHER PUBLICATIONS

Patent Abstracts of Japan, vol. 6, No. 61 (M-123) Apr. 20, 1982 JP-A-57-4372 (Chuo Hatsujiyou), Sep. 1, 1982; Formation of Additive Mass for Cable.

Patent Abstracts of Japan, vol. 9, No. 326 (M-441), Dec. 12, 1985 JP-A-60-158968 (Nihon Furetsuku), Aug. 20, 1985; Casting Method of Terminal Parts for Steel Wire Rope.

*Primary Examiner*—Andrew V. Kundrat

*Attorney, Agent, or Firm*—Frishauf, Holtz, Goodman & Woodward

[57] ABSTRACT

A method for forming an fixing end portion of a composite rope comprises the steps of mounting a mold on an end portion of the rope, pouring a molten metal in a cavity defined between the end portion of the rope and the mold under pressure, covering a predetermined part of the end portion of the rope with a cast metal formed from the molten metal, cold-pressing the cast metal and fixing the portion coated with the cast metal to a fixing member.

17 Claims, 12 Drawing Sheets

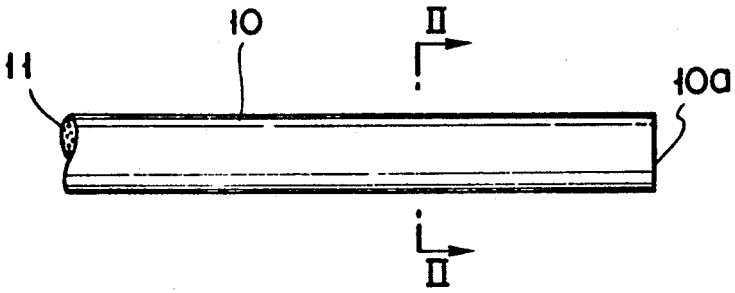
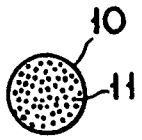
FIG. 1 FIG. 2
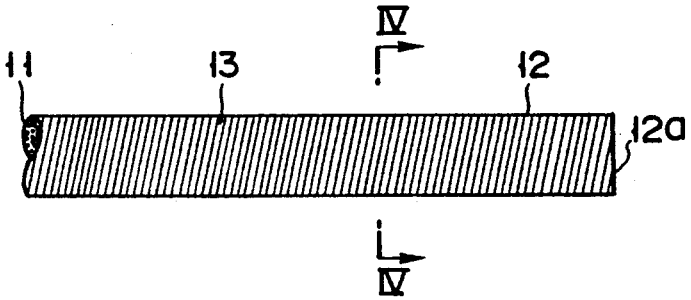
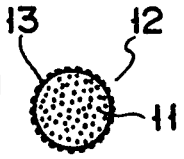
FIG. 3 FIG. 4
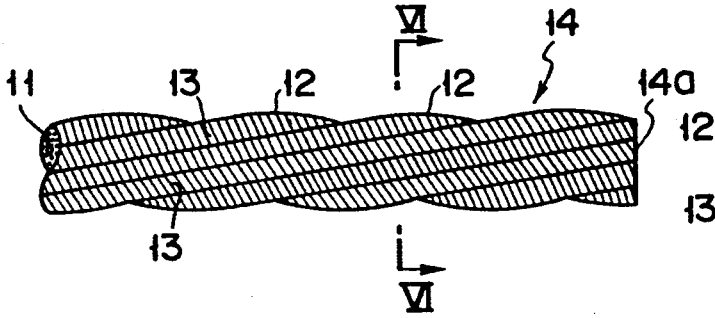
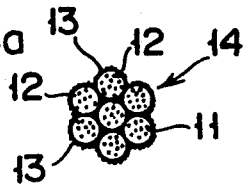
FIG. 5 FIG. 6

COMPOSITE ROPE HAVING MOLDED-ON FIXING MEMBER AT END PORTION THEREOF

This is a division of application Ser. No. 07/502,457, filed Mar. 30, 1990, now U.S. Pat. No. 5,027,497.

BACKGROUND OF THE INVENTION

1. Field of the Invention

The present invention relates to a method for forming a fixing end portion of a composite rope used for suspending marine-transportation equipment or for anchoring a boat, as a cable for controlling an automobile or an aircraft, as a member for reinforcing a concrete structure or a structure which must be prevented from becoming magnetized, or a non-loosened member for reinforcing a cable. The present invention also relates to a composite rope having a fixing end portion used in combination with the above-mentioned rope, cable, or reinforcing member.

2. Description of the Related Art

U.S. Pat. No. 4,677,818, U.S. Ser. No. 427,171, Examined Japanese Patent Publications Nos. 57-25679 and 62-18679 disclose a technique of impregnating filaments having a high tensile strength and a low elongation with a thermosetting resin to manufacture composite ropes which are lighter in weight and more corrosion-resistant than wire ropes and have the substantially same tensile strength and elongation as the latter.

A composite rope is not only very light in weight and highly corrosion-resistant but also has a high tensile strength, a low extension, and a low relaxation. Because of these excellent physical and chemical properties, attempts have been made to use a composite rope as a tightening member for prestress concrete, pretension type concrete, and post-tension type concrete, and as an outcable, in place of a steel wire rope.

When the composite rope made of filaments having a high tensile strength and a low elongation, it is important to securely connect an end portion of the composite rope with a fixing member with ease, at a high accuracy and at a low cost.

Conventional, methods by which the ends of composite ropes are formed include an eye splicing method or a rope slicing method. These conventional methods, however, can be applied to easily loosened/flexible ropes but are not applicable to the above-mentioned composite ropes as hard unloosened/non-flexible.

According to another conventional fixing method, a wedge type cone (male cone) is directly fixed to an end portion of a rope and is inserted in a socket (a female cone), to connect the end portion with the socket. In the case of this third conventional method, however, a local shearing stress is directly applied from the cones to the composite rope, with the result that the composite rope can easily be broken at its fixing end portion. Thus, a required fixing strength cannot be obtained using this method. Further, since the composite rope is imperfectly stuck to the male cone, its diameter is reduced when a pulling force is applied thereto, with the result that it can easily be pulled out of the male cone.

Unexamined Japanese Patent Application No. Hei 1-272889 discloses a technique of coating, with a resin layer, an end portion of a composite rope to which a cone is fixed, in order to reduce the local shearing stress applied to the composite rope.

This method, however, has drawbacks in that it takes several days for the coating resin to fully cure, and the resin cannot with stand high temperatures.

SUMMARY OF THE INVENTION

An object of the present invention is to provide a method for fast forming a fixing end portion of a composite rope in a short time.

Another object of the present invention is to provide a method of forming a fixing end portion of a composite rope which is small and lightweight and has a high fixing strength.

According to an aspect of the present invention, there is provided a method of forming a fixing end portion of a composite rope, comprising the step of mounting mold means, having molten metal supply means, on an end portion of a composite rope, the step of supplying a molten metal from the molten metal supply means to a cavity defined by the end portion of the composite rope and the mold means, and coating a predetermined area of the end portion with a cast metal formed from the molten metal, the step of pressing the cast metal, and the step of fixing the end portion, coated with the cast metal, to a fixing member.

On one hand, it is preferable that the length of end portion coated with the cast metal be as short as possible. On the other hand, it is desirable that the length of the area be as great as possible in order to obtain a fixing strength greater than a predetermined value. In order to meet these two conflicting requirements, it has been determined that the length of end portion coated with the cast metal should be within the range of 15 to 40 times the diameter of the composite rope.

It is recommended that the cast metal be selected from metals having a low melting point, i.e., between 200° to 600° C.; in particular, zinc alloy, aluminum alloy, or lead alloy. The upper limit of the melting point of is set to 600° C. in order to reduce thermal deterioration of the composite rope, since if a metal having a melting point of over 600° C. is cast on an end portion of a composite rope and even if rapidly cooled, the tensile strength of the composite rope will be drastically reduced. The lower limit of the melting point is set to 200° C. because there is no metal or metal alloy having the required mechanical strength whose melting point is less than this value.

It is preferred that the pressure applied to the fixing portion of the rope be that produced by a pressing machine, in order to ensure that the strength of adhesion of the cast metal to the composite rope is as high as possible.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIG. 1 is a front view of an end portion of a composite rod;

FIG. 2 is a cross-sectional view of the composite rod of FIG. 1;

FIG. 3 is a front view of an end portion of a composite rod surrounded by a coating layer;

FIG. 4 is a cross-sectional view of the composite rod of FIG. 3;

FIG. 5 is a front view of an end portion of a composite rope formed by twisting a plurality of composite rod together;

FIG. 6 is a cross-sectional view of a composite rope of FIG. 6;

DETAILED DESCRIPTION OF THE PREFERRED EMBODIMENTS

Figure 7:
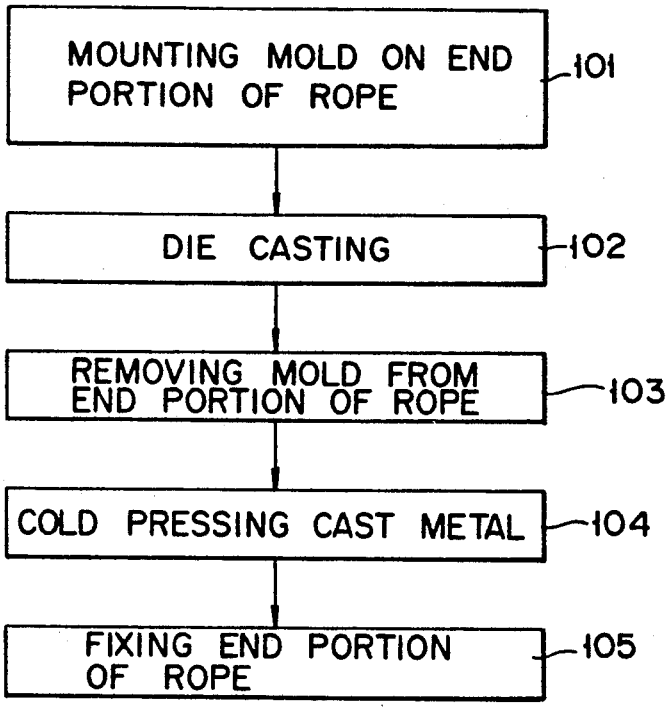
FIG. 7 is a flow chart showing the processes for forming a fixing end portions of composite ropes of the present invention.

This invention will now be described in detail, by way of embodiments and with reference to the accompanying drawings.

Various types of composite ropes—such as are shown in FIG. 1 to 6—are commercially available. A composite rope 10 as shown in FIGS. 1 and 2 is formed by impregnating a bundle of fabric fibers 11, having a high tensile strength and a low elongation, with thermosetting resin and thereafter thermally curing the same. Carbon fiber, aramid fiber, silicon carbide fiber, or the like is used as the fabric fiber 11 having a high tensile strength and a low elongation, while epoxy resin, unsaturated polyester resin, polyurethane resin, or the like is used as the thermosetting resin.

A composite rod 12 as shown in FIGS. 3 and 4 is manufactured by way of a plurality of bundles of fabric fibers impregnated with thermosetting resin being twisted together, and thereafter composite fibers 13 made of polyester and nylon are wound around the assembly, so as to cover it, to solidify the resin by heating.

A composite rope 14 as shown in FIGS. 5 and 6 is formed by twisting seven coated rods 12 and then solidifying the resin by heating.

Referring to FIGS. 7 to 19, the first embodiment of the method of this invention will now be explained.

Figure 8:
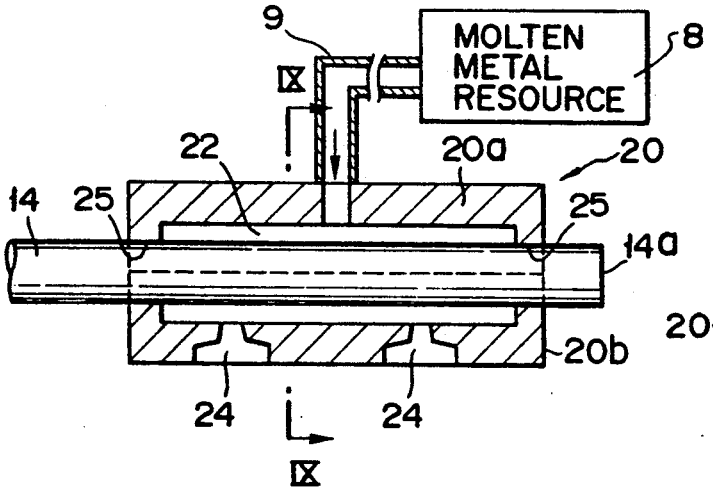
FIG. 8 is a longitudinal sectional view of an end portion of a composite rope of the first embodiment inserted in a metallic mold.

FIRST EMBODIMENT (I) As is shown in FIG. 8, a metallic mold 20 comprises an upper metallic mold half (or upper metallic mold section) 20*a* and a lower metallic mold half (or lower metallic mold section) 20*b*. These mold halves are mounted on a predetermined part of an end portion of the composite rope 14 (STEP 101 in FIG. 7), and their inner surfaces are coated with a separating material.

Figure 9:
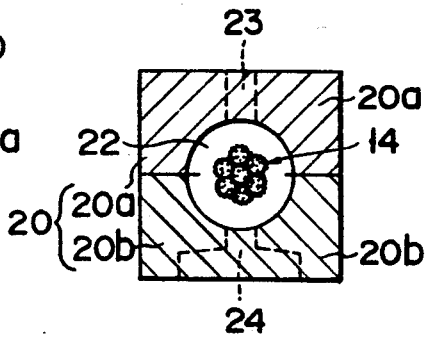
FIG. 9 is a cross-sectional view of the end portion of FIG. 8.
Figure 10:
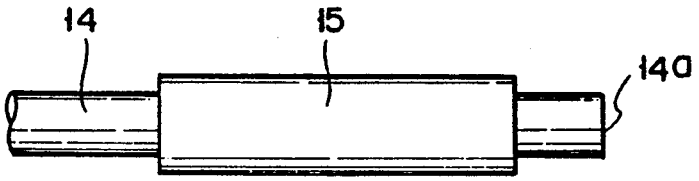
FIG. 10 is a front view of a die-cast end portion of the composite rope of the first embodiment.

As is shown in FIG. 9, an annular space is formed between the tip portion of the rope and the metallic mold halves 20*a* and 20*b* so that the separation therebetween is substantially the same in all radial directions. The tip portion 14*a* of the rope 14 projects a predetermined length out of the metallic mold halves 20*a* and 20*b*.

Spiral grooves (not shown) are formed in the inner peripheral surfaces of rope insertion holes 25 formed in both ends of the metallic mold halves 20*a* and 20*b*. Projecting portions of the uneven surface of the rope 14 are fitted in the grooves to maintain in an air-tight state a cavity 22 formed in the metallic mold. Preferably the rope 14 has an outer diameter of 7.5 mm, and the cavity has an outer diameter of 12.7 mm and a length of 90 mm.

(II) A molten metal pouring hole 23 is formed in the upper metallic mold half 20*a*, and a pair of vent holes 24 are formed in the lower metallic mold half 20*b*. The holes 23 and 24 communicate with the cavity 22. A molten metal resource 8 which contains molten zinc alloy is connected via a passage 9 with the molten metal pouring hole 23. The molten metal resource 8 has a heating unit (not shown) and a pressurization unit (not shown) which is provided with a pressure regulating valve. Zinc alloy (having a melting point of 390° C. is heated to a temperature of approximately 430° C. in the resource 8, and consists of 3 to 4 weight % of Al, 3 to 4 weight % of Cu, 0.02 to 0.06 weight % of Mg, at most 1 weight % of Ti, at most 1 weight % of Be, with the balance being Zn.

Molten zinc alloy is poured through the molten pouring hole 23 into the cavity 22 at a supply pressure of approximately 150 kgf/cm$^2$ (STEP 102), is rapidly cooled by the metallic mold 20, and quickly solidifies. The faster the solidification time, the higher the quality of the fixing portion obtained. As far as cooling speed is concerned, it is sufficient to cool a rope having a small size at rate of natural air cooling, but it is preferred that a large size rope be cooled quickly as possible.

(III) The metallic mold 20 is removed from the end portion of the rope 14 (STEP 103), and a fixing portion 15 made of zinc alloy is formed thereon. Thereafter, the fixing portion 15 is burred.

In this embodiment, the fixing portion 15 is cylindrical, but may also be polygonal in cross section.

Figure 11:
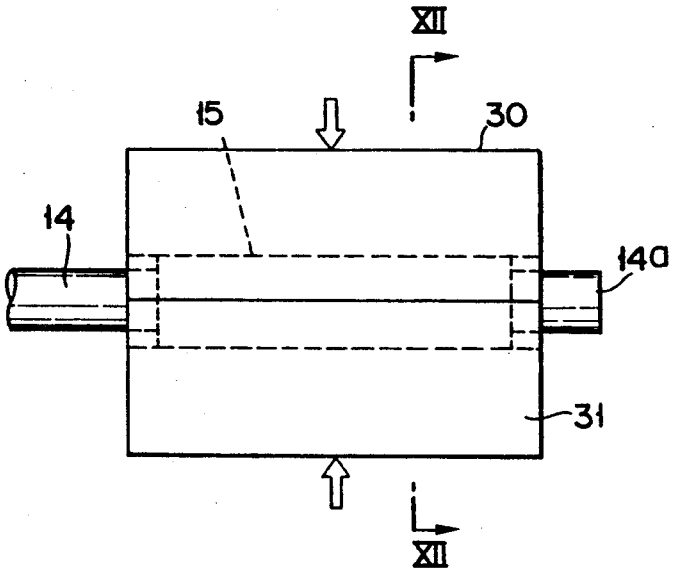
FIG. 11 is a front view of an end portion of the composite rope mounted in a metallic mold of a cold pressing machine.
Figure 12:
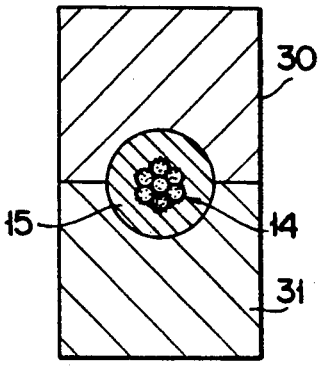
FIG. 12 is a cross-sectional view of the composite rope mounted in the metallic mold of the cold pressing machine, of FIG. 11.

(IV) As is shown in FIGS. 11 and 12, the fixing portion 15, on the tip portion 14*a* of the rope 14, is sandwiched by a pair of metallic molds 30 and 31 and is cold-pressed by a cold pressing machine, with these molds (STEP 104) interposed therebetween. The pressing force applied by the pressing machine is at most 7 tons/cm$^2$.

This cold pressing process causes the fixing portion 15 to be tightly and firmly connected with the end portion of the rope 14. Although cold pressing is preferable to obtain a predetermined fixing strength, a hot pressing process can also be employed.

Figure 13:
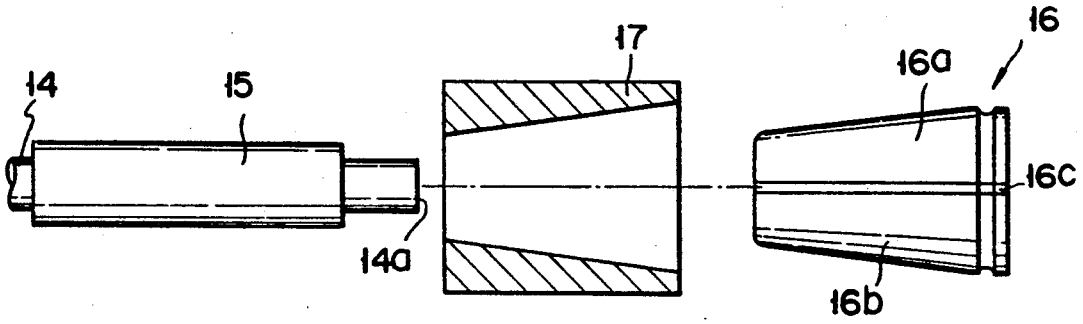
FIG. 13 is a front view of a combination of an end portion of the composite rope, a male cone, and a female cone.
Figure 14:
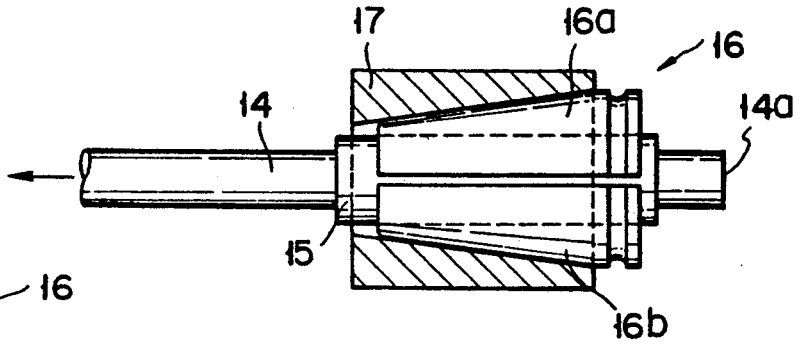
FIG. 14 is a longitudinal sectional view of the end portion of the composite rope inserted in the female and male cones of FIG. 13, with the female cone shown in a longitudinal sectional view.
Figure 15:
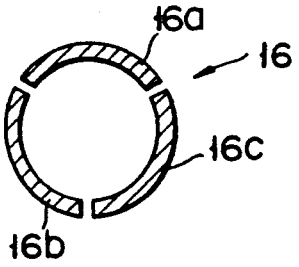
FIG. 15 is a cross-sectional view of a three-split type male cone of the first embodiment.
Figure 17:
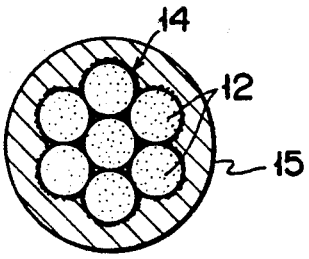
FIG. 17 is a cross-sectional view of a die-cast end portion of a composite rope of the first embodiment.

(V) As is shown in FIGS. 13 and 14, a male cone comprising three male cone sections, 16*a*, 16*b*, and 16*c*, of the same shape and size (see FIG. 15), is mounted on the fixing portion 15, and a socket (female cone) 17 fixed to a fixing member of a structure (not shown) is inserted in the male cone. As the rope 14 is pulled in the direction opposite to that toward its tip portion 14*a*, the male cone sections 16*a*, 16*b*, and 16*c*, guided by the tapered inner surface of the socket 17, are pressed against the outer peripheral surface of the fixing portion 15 of the rope 14 such that they are fixed to the end portion of the rope 14 by a chucking action (STEP 105).

Figure 16:
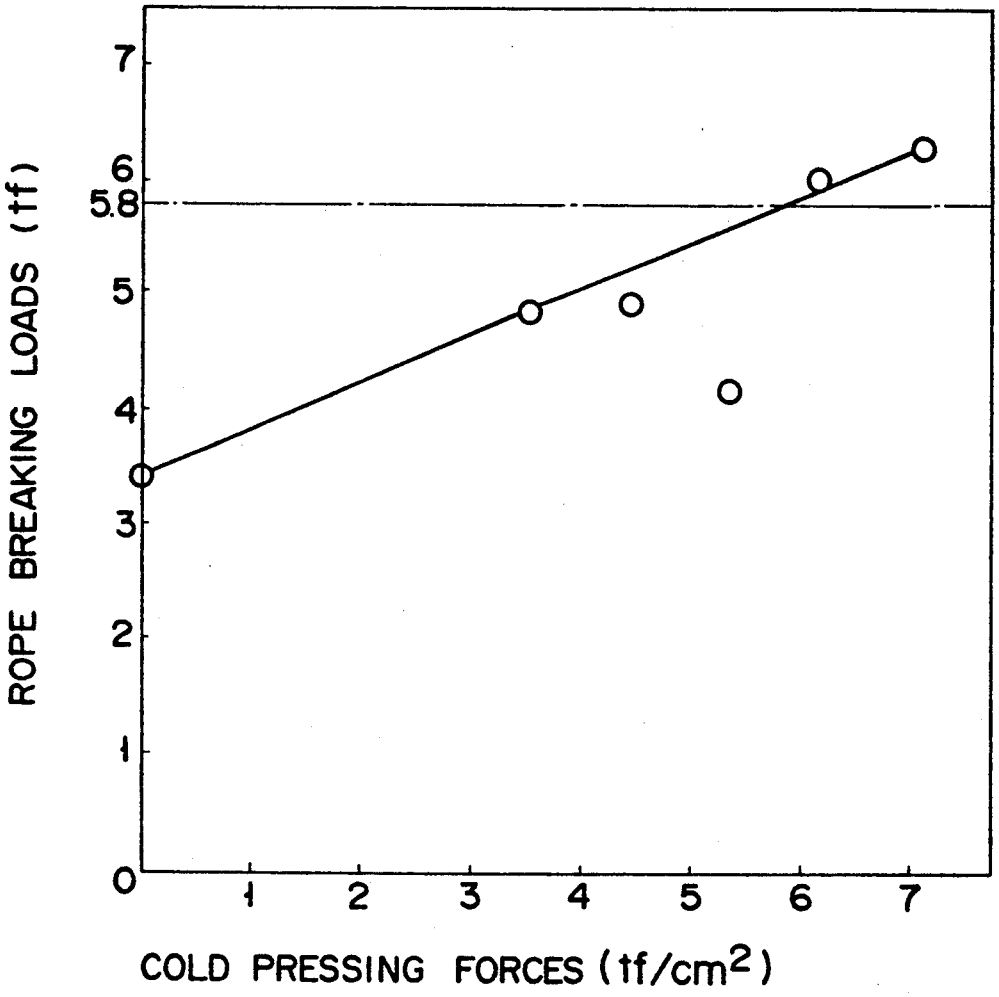
FIG. 16 is a graph showing a relationship between compressing forces of the cold pressing machine and rope cutting loads, in order to explain the technical advantages of the first embodiment.

FIG. 16 is a graph showing the relationship between the cold pressing forces and the rope breaking loads, where the cold pressing forces are taken along the abscissa and the rope breaking loads are taken along the ordinate. As is apparent from this graph, the actual rope breaking loads exceed the rated rope breaking load of 5.8 tons within the range of the cold pressing forces spanning 6.12 to 7.00 tons/cm$^2$.

Cyclic forces having an average value of 60% of the rated rope breaking load and an amplitude of 2.5 kgf/mm$^2$ were applied to the fixing portion on the end portion of the ropes, in order to test their fatigue characteristic. From the results of this experiment, it can be seen that the fixing portions were not broken when the forces were repeatedly applied thereto $2\times10^6$ times.

The same fixing method can be applied to the composite rods 10 and 12.

Figure 18:
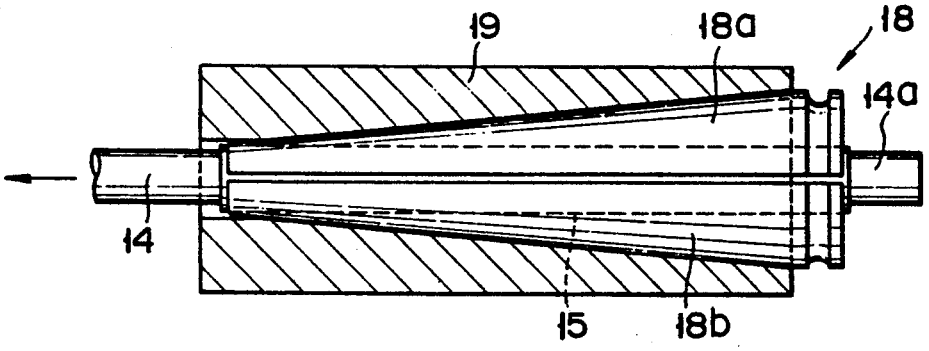
FIG. 18 is a longitudinal sectional view of the end portion of the composite rope inserted in a female cone and a male cone of FIG. 17.
Figure 19:
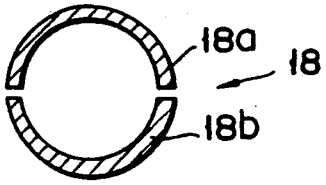
FIG. 19 is a cross-sectional view of a double-split type male cone of the first embodiment.

As are shown in FIGS. 18 and 19, two male cone sections, 18*a* and 18*b*, forming a male cone, and a socket (female cone) 19 used with the thick rope, are longer than those used in the case of the above-mentioned. The inner surfaces of the male cone sections 18*a* and 18*b* and the socket 19 are tapered gently so as to reduce the shearing stress exerted on an end portion of the rope 14.

The second embodiment will now be explained, with reference to FIGS. 20 and 21, with description of portions of this embodiment common to those of the first embodiment being omitted.

SECOND EMBODIMENT (I) That end portion of a composite rope 14 has been previously inserted in a socket (not shown). Referring to FIG. 20, a die-casting metallic mold 26 has a tapered cavity 27 and is mounted on a predetermined part of the end portion of the composite rope 14 in such a manner that the end of the cavity 27 having the larger diameter is positioned close to the tip portion 14*a* of the rope 14 (STEP 101).

Figure 20:
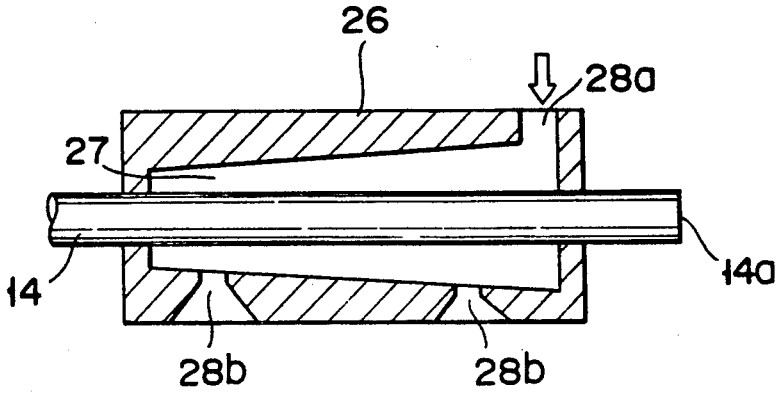
FIG. 20 is a longitudinal sectional view of an end portion of a composite rope inserted in a metallic mold in the second embodiment.

(II) As is shown in FIG. 20, a molten metal pouring hole 28*a* and a pair of vent holes 28*b* are formed in the metallic mold 24 so as to communicate with the cavity 27.

A molten metal is poured through the molten metal pouring hole 28*a* into the cavity 27 (STEP 102) and is rapidly cooled so as to solidify quickly. The shorter the solidification time, the better the quality of the fixing portion 29 obtained.

Figure 21:
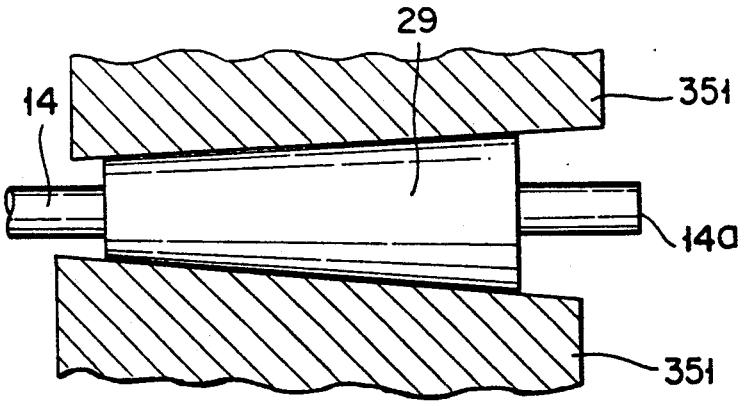
FIG. 21 is a front view of a die-cast end portion of the composite rope of the second embodiment.

(III) The metallic mold 26 is removed from the end portion of the rope 14 (STEP 103), and as is shown in FIG. 21, the conical fixing portion 29 is formed on a predetermined part thereof.

(IV) The fixing portion 29, on the end portion of the rope 14, is cold-pressed (STEP 104) so as to be tightly and firmly connected with the rope 14.

(V) As the rope 14 is pulled in a direction from the tip portion 14*a* to the fixing portion 29, the fixing portion 29 is held and pressed by a socket formed in a fixing member 351 such that the end portion of the rope 14 is fixed together.

The method of the second embodiment has the advantage in that a male cone does not have to be provided.

The third embodiment will now be explained, with reference to FIGS. 22 to 26, with description of portions of this embodiment common to those of the first embodiment being omitted.

Figure 22:
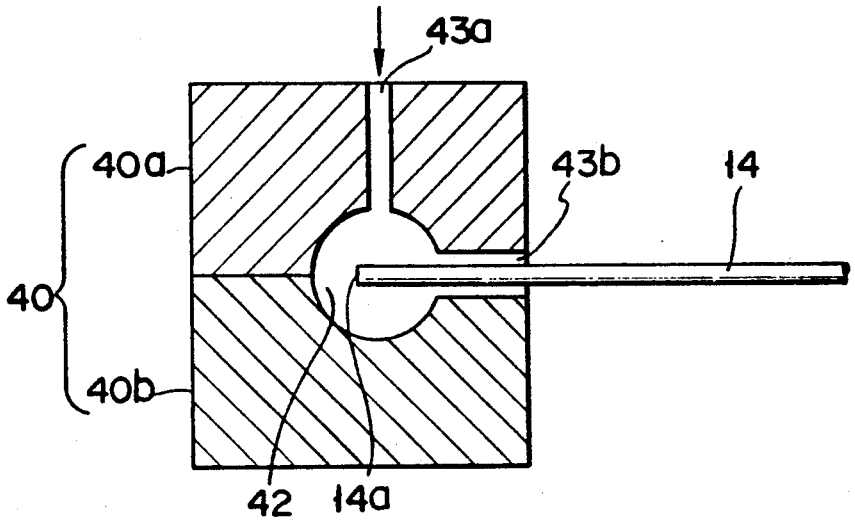
FIG. 22 is a longitudinal sectional view of an end portion of a composite rope inserted in a metallic mold of the third embodiment.

THIRD EMBODIMENT (I) As is shown in FIG. 22, a ba)1-like cavity 42 is formed in a metallic mold 40, having an upper metallic mold half 40*a* and a lower metallic mold half 40*b*. A molten metal pouring hole (passage) 43*a* and a vent hole 43*b*, which also acts as a rope-end-portion inserting hole, are formed in the metallic mold assembly so as to communicate with the cavity 42.

An end portion of the composite rope 14 is inserted in the vent hole 43*a* so that the tip portion 14*a* of the rope 14 is disposed in the cavity 42 (STEP 101). It is preferable that spacers (not shown) be placed in the vent hole 43*b* to provide a uniform gap between the end portion of the rope 14 and the metallic mold 40.

(II) A molten metal is poured from the molten metal pouring hole 43*a* into the cavity 42 (STEP 102), and is quickly cooled and solidified. A short solidification time is recommended in order to obtain a fixing portion of high quality.

Figure 23:
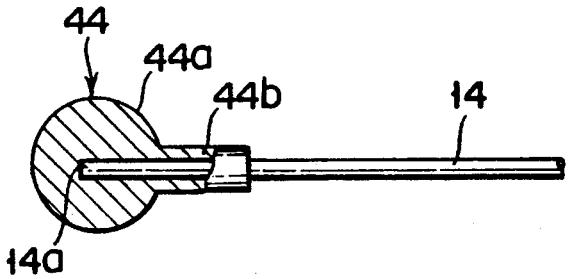
FIG. 23 is a partially broken view of an end portion (ball-like die-cast portion) of the third embodiment.

(III) The metallic mold 40 is removed from the end portion of the rope 14, and then the solidified metal portion is burred (STEP 103) so as to form a ball-like fixing portion 44 which wraps around the tip portion of the rope 14, as is shown in FIG. 23.

(IV) The ball part 44*a* and the neck part 44*b* of the fixing portion 44 are simultaneously cold-pressed (STEP 104) so that the fixing portion 44 is tightly and firmly connected to the end portion of the rope 14. In this example, the diameter of the ball part 44*a* is 30 mm and the length of the neck part 44*b* is 60 mm. Preferably, the length of the neck part 44*b* should be as long as possible in order to maximize the fixing strength with which the fixing portion is connected to the end portion of the rope.

Figure 24:
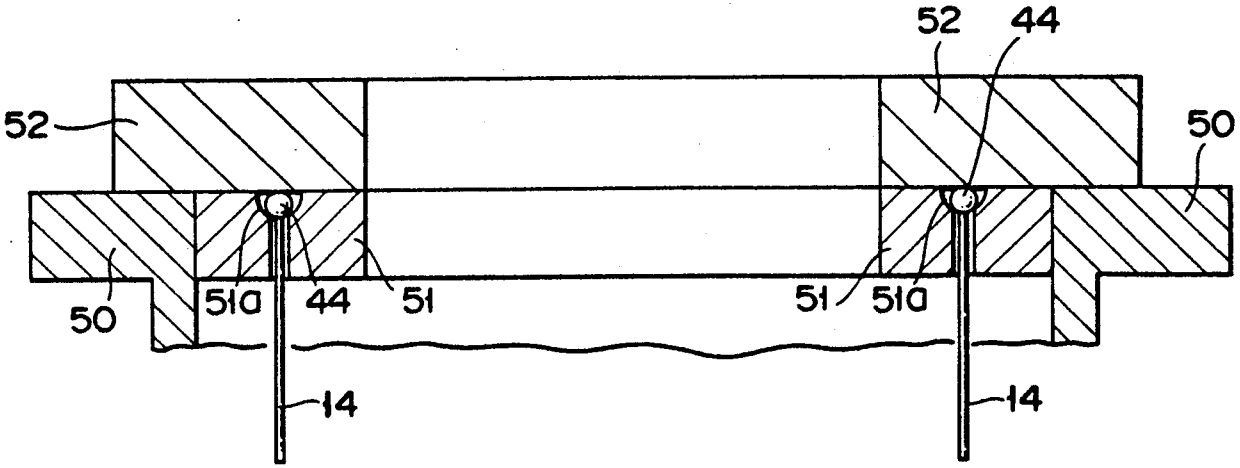
FIG. 24 is a partially broken view of an end portion of a composite rope securely connected to a fixing member.

(V) As is shown in FIG. 24, the end portions of the ropes 14 are fixed to a frame 50 for forming a prestress concrete pillar. Specifically, an end metallic member 51 having recesses 51*a* engaged with the fixing portions 44 of the ropes 11 is threadably engaged with the inner wall of the frame 50 and is fixed to a plate 52 disposed on the upper surface of the end metallic member 51. As the plate 52 is rotated in the direction in which it moves upwardly with respect to the frame 50, the end metallic member 51 is also displaced upwardly to pull the ropes 14.

Figure 26:
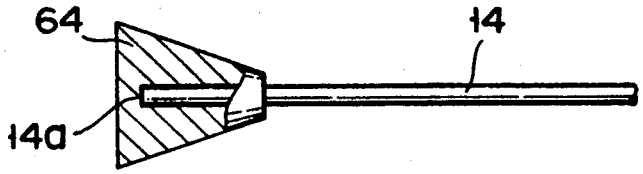
FIG. 26 is a partially broken view of the end portion (conical-shaped die-cast portion) modified from the third embodiment.
Figure 25:
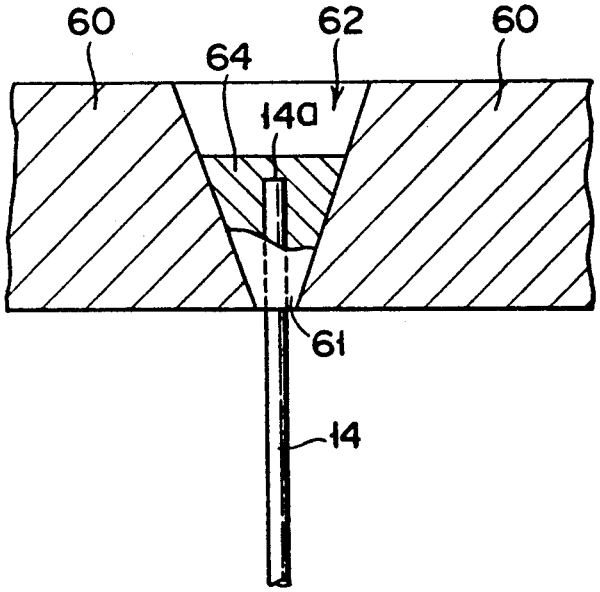
FIG. 25 is a partial broken view of an end portion of a composite rope inserted in a metallic mold modified from the third embodiment.

As is shown in FIGS. 25 and 26, a split type mold 60 having a conical cavity 62 may be used. The tip portion 14*a* of a rope 14 is inserted in the cavity 62 through a vent hole 61 and then a molten metal is poured into the cavity 62, whereby a conical fixing end portion 64 is formed on an end portion of the rope 14.

In the third embodiment, neither a male cone nor a socket is required. Further, since only the tip portion 14*a* of the rope 14 is wrapped in the fixing portion 44 or 64, a short and compact fixing portion can be obtained.

The fourth embodiment will now be explained, with reference to FIGS. 27 and 28, with description of portions of this embodiment common to those of the first embodiment being omitted.

Figure 27:
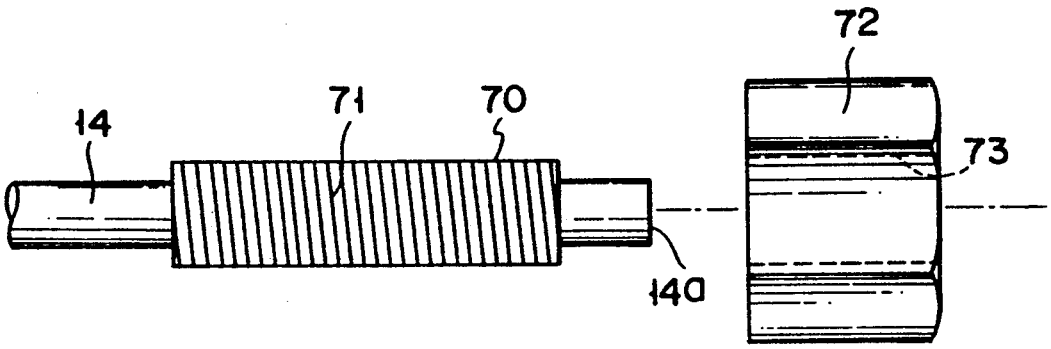
FIGS. 27 and 28 are front views of an end portion of a composite rope of the fourth embodiment.

FOURTH EMBODIMENT (I) As is shown in FIG. 27, a spiral groove 71 is formed in the outer peripheral surface of a fixing portion 70 formed by means of the same processes as used in the first embodiment. A nut 72 is provided having inner threads 73 engageable with the spiral groove 71.

Figure 28:
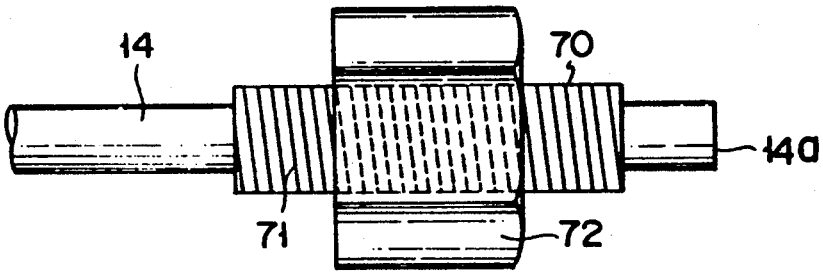

(II) As is shown in FIG. 28, the fixing portion 70 is inserted in the insertion hole of a fixing member (not shown), from the end of the fixing portion 70 remote from the tip portion 14*a* of a rope 14, so as to be threadably engaged therewith, and the nut 72 is screwed into the fixing portion 7 from the tip portion side of the rope 14. The fixing portion 70 is connected to the fixing member by means of the nut 72. If a longer fixing portion 70 is formed on the end portion of the rope 14, a number of the nuts 72 can be mounted on the fixing portion 70 to increase the fixing strength to a required value.

Figure 29:
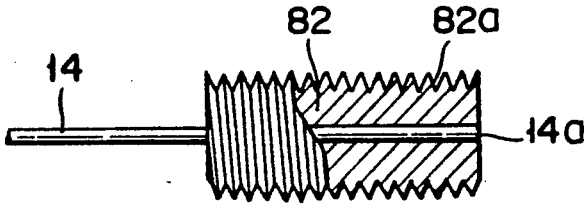
FIGS. 29 and 30 are longitudinal sectional views of an end portion of a composite rope of the fifth embodiment.

FIFTH EMBODIMENT (I) As is shown in FIG. 29, a fixing portion 82 is formed by means of the same processes as used in the fourth embodiment. Thereafter, a part of the end portion of a rope 14 projecting from the end of the fixing portion 82 at the tip portion side of the rope 14 is cut so that the new tip portion 14*a* of the rope 14 is flush with the tip side end of the fixing portion 82.

Figure 30:
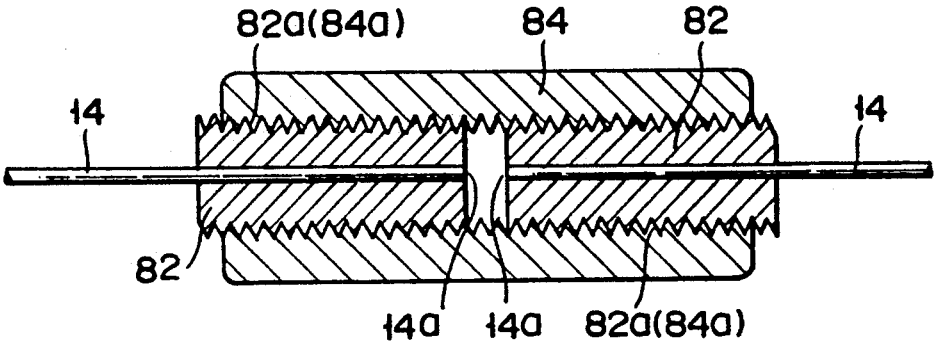

(II) As is shown in FIG. 30, two fixing portions 82 are screwed one into either end of a nut 84, whereby two ropes 14 are connected together.

Thus, in the fifth embodiment, the ropes can be quickly connected together by means of a simple connecting operation.

Figure 31:
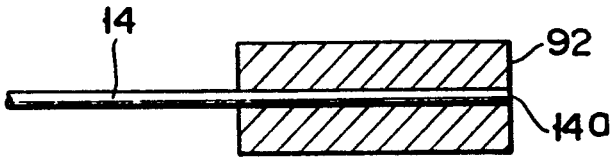
FIGS. 31 and 32 are longitudinal sectional views of an end portion of a composite rope of the sixth embodiment.

SIXTH EMBODIMENT (I) As is shown in FIG. 31, a fixing portion 92 is formed by means of the same processes as used in the first embodiment. Then, the end portion of a rope 14 projecting from the end of the fixing portion 82 at the tip portion side of the rope 14 is cut so that the new tip end 14*a* of the rope 14 is flush with said tip side end of the fixing portion 82.

Figure 32:
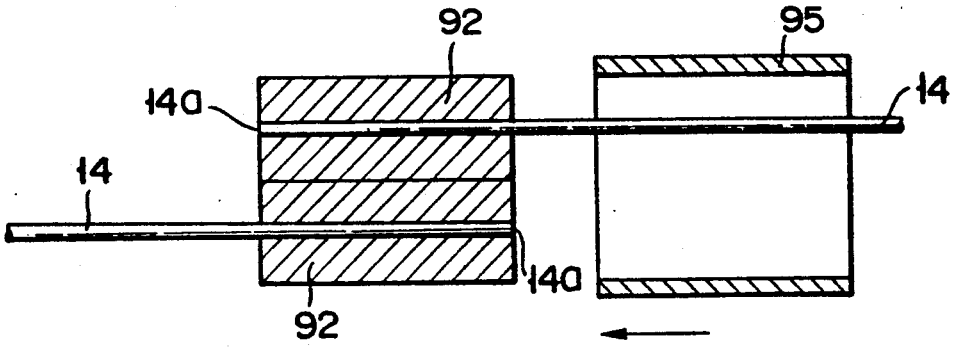

(II) As is shown in FIG. 32, two fixing portions 82 are screwed one into either end of a grip 95.

Figure 33:
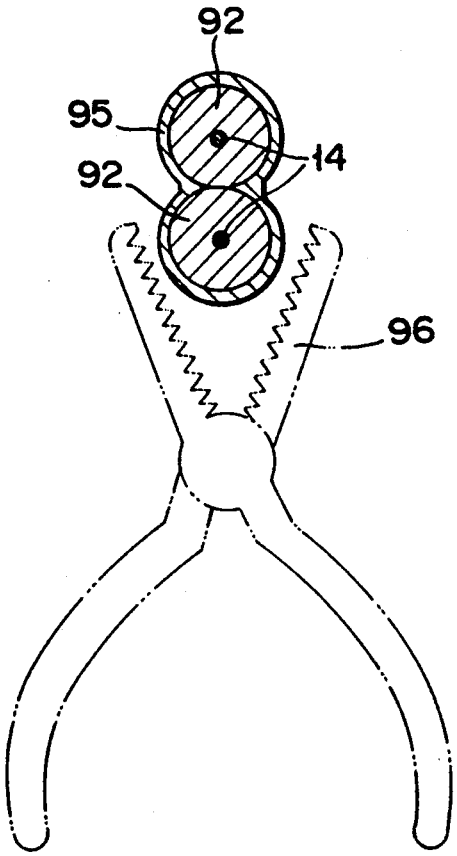
FIGS. 33 and 34 are cross-sectional views of the end portion of a composite rope of the sixth embodiment.
Figure 34:
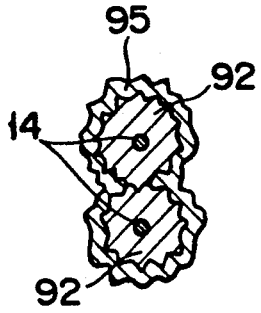

(III) The grip 95 is then squeezed by a squeezing tool 95, as is shown in FIG. 33, so that the grip 95 and two fixing portions 92 are deformed and fixed together.

Thus, in the sixth embodiment also, the ropes can be connected to each other quickly and simply The technical advantages of the present invention can be summarized as follows:

Fixing end portions are fast formed on various sizes of composite ropes in a short time, and the end portions of the ropes can be connected with fixing members rapidly and firmly.

Shearing stresses imposed on the end portions of the ropes by fixing members including cones and sockets are reduced by way of a metal layer coated on the end portions of the rope.

Fast cooling and solidification of a molten metal reduces the adverse thermal effects imposed on the ropes. Therefore, the mechanical strength of the end portions of the ropes is higher than in the case of conventional ropes, and the intensity (strength) of concrete structures, etc. are, accordingly, greatly enhanced.

The heat-resistance of the end portions of the ropes is increased, with the result that such ropes can be used in heat-resistance structures employed in a fairly high-temperature environment.

When ball-shaped end portions or conical end portions are used, neither a male cone nor a socket is required, whereby the size of the rope fixing portions can be kept to a minimum. In particular, when such end portions are employed in the manufacturing of prestress concrete pillars, the composite ropes can be arranged close to the outer lateral surfaces of the concrete pillars, and the deposit portions of the concrete pillars can be rendered thinner than conventionally, with the result that the concrete pillars can be rendered lighter in weight.

Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A composite rope structure having an end portion thereof fixed to a stationary member, said composite rope structure comprising:

a composite rope made of resin-impregnated non-metallic multifilaments;

a cast metal member molded on said end portion of said composite rope, said cast metal member extending over a substantial length of said end portion of said composite rope, said cast metal member being molded on said end portion of said composite rope by supplying molten metal into a cavity of a mold that covers a predetermined substantial length of said end portion of said composite rope;

means for initially pressing said cast metal member against said end portion of said composite rope by applying to said cast metal member, a pressing force that is distributed by said cast metal member over said predetermined substantial length of said end portion of said composite rope to increase an adhesion between said cast metal member and said composite rope over said predetermined substantial length of said composite rope, said pressing force distributed by said cast metal member over said predetermined substantial length of said end portion of said composite rope being insufficient to damage said composite rope; and a fixing member surrounding and clamping at least a portion of the cast metal member after the cast metal member is initially pressed against said end portion of said composite rope, said at least a portion of said cast metal member having a cross-sectional shape that is not deformable by a clamping force provided by said fixing member;

said fixing member, fixing said at least a portion of said cast metal member to said stationary member;

said clamping force provided by said fixing member being substantially uniformly distributed by said cast metal member in a longitudinal direction of said composite rope to said end portion of said composite rope such that a rope-damaging shearing stress is not applied to said composite rope.

2. The composite rope structure of claim 1, wherein said cast metal member is molded onto said end portion of said composite rope by hardening a molten metal that is supplied into said cavity of said mold under pressure.

3. The composite rope structure of claim 1, wherein:

said fixing member includes a male cone member mounted on a part of said end portion of said composite rope that has said cast metal member formed thereon; and further comprising:

a female cone member fixed to said male cone member.

4. The composite rope structure of claim 1, wherein said cast metal member is cold-pressed against said end portion of said composite rope.

5. The composite rope structure of claim 1, wherein said cast metal member is molded on said end portion of said composite rope, except for a tip portion of said composite rope.

6. The composite rope structure of claim 1, wherein said cast metal member has a substantially cylindrical shape.

7. The composite rope structure of claim 1, wherein said cast metal member has a substantially conical shape.

8. The composite rope structure of claim 1, wherein said cast metal member has a spiral groove on an outer peripheral surface thereof which is formed by said pressing of said cast metal member against said end portion of said composite rope.

9. The composite rope structure of claim 1, wherein said cast metal member is directly fixed to said fixing member.

10. The composite rope structure of claim 1, wherein said cast metal member has a melting point within a range of 200° to 600° C.

11. The composite rope structure of claim 1, wherein said cast metal member comprises a zinc alloy.

12. The composite rope structure of claim 1, wherein said molten metal is rapidly cooled to form said cast metal member.

13. The composite rope structure of claim 1, wherein said cast metal member is pressed with a pressing force of at least 6 $tf/cm^2$.

14. The composite rope structure of claim 1, wherein said cast metal member is pressed in at least two different directions.

15. The composite rope structure of claim 3, wherein said male cone member is arranged within said female cone member such that the cone shapes of said male and female cone members mate with each other, and wherein said composite rope structure is pulled in a direction to force said male cone member toward a smaller diameter portion of said female cone member to press said male cone member within said female cone member under said pulling force, to thereby fix said female cone member to said male cone member.

16. The composite rope structure of claim 1, wherein said cast metal member has a length 10 to 15 times greater than a diameter of said elongated composite rope.

17. The composite rope structure of claim 1, wherein said cast metal member has an outer diameter 1.5 to 3 times greater than a diameter of said elongated composite rope.

* * * * *